US011211178B2

(12) United States Patent
Watanabe et al.

(10) Patent No.: US 11,211,178 B2
(45) Date of Patent: Dec. 28, 2021

(54) TRANSPARENT NEUTRON SHIELDING MATERIAL

(71) Applicants: MITSUBISHI CHEMICAL CORPORATION, Tokyo (JP); CO. LTD. RSC, Tokyo (JP)

(72) Inventors: Yuusuke Watanabe, Tokyo (JP); Akihiro Itou, Tokyo (JP); Takaya Shinmura, Tokyo (JP); Teruo Hashimoto, Tokyo (JP); Takaaki Kishimoto, Tokyo (JP)

(73) Assignees: MITSUBISHI CHEMICAL CORPORATION, Tokyo (JP); CO. LTD. RSC, Tokyo (JP)

( * ) Notice: Subject to any disclaimer, the term of this patent is extended or adjusted under 35 U.S.C. 154(b) by 448 days.

(21) Appl. No.: 16/302,512

(22) PCT Filed: Jun. 6, 2017

(86) PCT No.: PCT/JP2017/021555
§ 371 (c)(1),
(2) Date: Nov. 16, 2018

(87) PCT Pub. No.: WO2017/213265
PCT Pub. Date: Dec. 14, 2017

(65) Prior Publication Data

US 2019/0221324 A1 Jul. 18, 2019

(30) Foreign Application Priority Data

Jun. 9, 2016 (JP) ..... JP2016-115558

(51) Int. Cl.
*G21F 1/10* (2006.01)
*G21F 3/00* (2006.01)

(52) U.S. Cl.
CPC ..... *G21F 1/103* (2013.01); *G21F 3/00* (2013.01)

(58) Field of Classification Search
CPC ... G21F 3/00; G21F 1/10; G21F 1/103; C08G 59/24; C08G 59/1477; C08G 59/2006; C08G 59/5026; C08G 59/5073
See application file for complete search history.

(56) References Cited

U.S. PATENT DOCUMENTS

2001/0053817 A1 12/2001 Anayama et al.
2005/0258405 A1* 11/2005 Sayala ..... G21F 1/06 252/582

FOREIGN PATENT DOCUMENTS

| | | | |
|---|---|---|---|
| JP | 08-201580 A | | 8/1996 |
| JP | 2001-310928 A | | 11/2001 |
| JP | 2001310928 A | * | 11/2001 |
| JP | 2003156591 A | | 5/2003 |
| JP | 2010-106009 A | | 5/2010 |
| JP | 2014-514587 A | | 6/2014 |
| JP | 2016-500743 A | | 1/2016 |

OTHER PUBLICATIONS

Office Action from German Patent Office issued in German Application No. 17 81 0437 dated Dec. 13, 2019 (3 pages).
International Preliminary Report on Patentability for PCT/JP2017/021555, dated Dec. 11, 2018 (1 pg.).
English translation of Written Opinion of the International Searching Authority for PCT/JP2017/021555, dated Sep. 5, 2017 (8 pgs.).
English language International Search Report for PCT/JP2017/021555 (2 pgs).
Masahiro Tajima, Yoeki Joka Sochiyo Hikari Kakusanbu Jushi no Sentei Shiken, Shimane-Ken Kenkyu Hokoku, No. 51 [online], Feb. 2015 (7 pgs).
Mitsui Chemicals, Inc., Kanjo Olefin Copolymer APEL Seihin Catalog [online], Mar. 2015 (6 pgs).

* cited by examiner

*Primary Examiner* — David E Smith
*Assistant Examiner* — Hsien C Tsai
(74) *Attorney, Agent, or Firm* — Flynn Thiel, P.C.

(57) ABSTRACT

Provided is a neutron shielding material having excellent transparency and high neutron shielding ability. In this neutron shielding material, light transmittance at wave length of 400 to 700 nm is 80% or greater, and the thickness of a 1/10 value layer of a neutron generated from Californium 252 is 14 cm or less.

8 Claims, No Drawings

TRANSPARENT NEUTRON SHIELDING MATERIAL

FIELD OF THE INVENTION

The present invention relates to a neutron shielding material which has excellent transparency.

DESCRIPTION OF THE PRIOR ART

Along with the growth of an atomic energy industry, it is becoming a very important theme to shield neutrons generated from facilities such as nuclear facilities (e.g. a nuclear reactor or a fast breeder reactor) or from facilities for medical neutron treatment, and to protect an operator from damage by neutrons. At the same time, for an operator who works in a hot laboratory or a hot cell, it is very important from the view point for the promotion of working efficiency that the neutron shielding material has transparency.

Because the neutron beam is characterized that energy dependency of conversion factor of radiation dose is very large, fast neutron beam, whose energy is high, has very high influence on external exposure of a human body. Therefore, by effectively shielding the fast neutron beam, it becomes possible to reduce external exposure by neutron beam. For the purpose of shielding the fast neutron beam, it is well known that the moderation by elastic scattering of light weight atoms such as the hydrogen atom, and materials containing high amounts of hydrogen is conventionally used as a neutron shielding material. For a neutron shielding material, it is very important to be cheap and to be easy to handle, and it is known that neutron energy is lost by elastic scattering. Accordingly, since an atom whose atomic number is relatively low is effective, hydrocarbon compounds containing relatively high numbers of hydrogen atoms (such as paraffins, polyethylene resin, epoxy resin or acrylic resin) are used and applied as structural parts for a radiation shielding material.

Especially, an epoxy resin has an advantage that a molding by casting method is possible and it is possible to secure the necessary thickness as a shielding material by one body molding method.

The JP 2014-514587 publication relates to an epoxy resin composition including a nano-size radioactive radiation shielding material and having good/superior shielding effects against radiation, and to a method for preparing same. In particular, the publication relates to a method for preparing the epoxy resin composition for neutron shielding, comprising the steps of; a step of mixing a boron compound powder for absorbing neutrons, optionally a high density metal powder for shielding against gamma-rays and a flame retardant powder, respectively separately or in combination, with an amine-based curing agent to obtain a mixture of a curing agent and a powder; an ultrasonic wave treating step of applying ultrasonic waves to the mixture to coat the surface of the powder with the amine-based curing agent to disperse the powder in the curing agent; and a dispersing step to mix and disperse the amine-based curing agent that was dispersed, and includes the powder treated with ultrasonic waves, in an epoxy resin.

However, there is no mention referring to transparency of a neutron shielding material in this patent publication.

An example which uses a transparent epoxy resin as a neutron shielding agent is disclosed the JP 2001-310928, however, there is only a disclosure as follows: "Transparency of a cured substance is generally measured by illuminance. For example, in a case that a cured substance is applied as a front of a special car, it is necessary to be maintained within the prescribed illuminance in the road traffic control law. In this invention, when the illuminance is kept over 50% under the adequate light source, it is judged that the transparency is properly maintained." According to this disclosure, the mentioned method is not the method prescribed as the ordinary method, for example, JISK7361 etc., which measures transparency of materials, therefore, transmissivity for each wavelength range is not indicated.

SUMMARY AND OBJECT OF THE INVENTION

Recently, along with the improvement of combustion efficiency of nuclear fuel or along with the use of MOX fuel, neutron beam radiation doses from used nuclear fuel are increasing.

In a case of a panel material for a hot laboratory or a hot cell which are used for reprocessing equipment of used nuclear fuel, although the material is a shielding material, transparency is required because it is necessary to observe the inside when a manipulator is used. Accordingly, the subject of this invention is to develop a shielding material which is superior in shielding efficiency and also has excellent transparency compared with the conventional neutron shielding materials. When such an excellent transparent shielding material is developed, it can be user for panel materials of equipment used to treat a radiation source releasing fast neutron beams, such as high burn up used nuclear fuel containing a high amount of spontaneous nuclear fission component. Further, reduction of external exposure of operators becomes possible.

As a neutron shielding material, various materials, such as metal materials, inorganic materials or high polymer materials which contain a high amount of hydrogen have been researched and are practical to use. According to this research, since high polymer materials are not only materials containing a high amount of hydrogen but are also excellent in transparency, it is possible to produce a molded object of relatively large size, and development is carried out by limiting the object of development to high polymer materials. Especially, a target of the present invention is narrowed down to the development of a neutron shielding material using an epoxy resin. Namely, the epoxy resin is applied to a glove-box that treats a nuclear fuel, has similar transparency with an acrylic resin which is a typical transparent neutron shielding material having over 90% light transmissivity at the visible radiation range, and is excellent in mechanical rigidity and in neutron shielding ability compared with the acrylic resin.

That is, the object of the present invention is to provide a transparent neutron shielding material at the visible radiation range. By the present invention, under exposure of radiation it becomes possible to observe the blue to violet range without coloration. Therefore, not only the observation of an inner operation domain can be done in full color, but also the blue color of Cerenkov radiation can be observed accurately. That is, accurate observation under exposure of radiation becomes possible.

Further, by using the neutron shielding material, it is possible to obtain large molded goods with a relatively large thickness.

The inventors of the present invention continued in earnest their study of epoxy resin, and conducted research in order to develop an epoxy resin composition having transparency and also having a neutron shielding effect, and found that the transparent epoxy resin composition having a neutron shielding effect can be obtained by combining a specific epoxy resin with a curing agent, and then accomplished the present invention.

That is, as mentioned below, the present invention provides a curable epoxy resin composition, a cured product thereof and a producing method thereof.

The important factors of the present invention are:

(1) A neutron shielding material whose light transmittance at a wavelength of from 400 nm to 700 nm is 80% or greater, and the thickness of 1/10 value layer of neutron beam generated from Californium 252 is 14 cm or less.

(2) The neutron shielding material of (1), wherein the neutron shielding material is a cured product of an epoxy resin composition.

(3) The neutron shielding material of (2), wherein the number density of hydrogen atom of the epoxy resin composition is $6.78\times10^{22}$ atoms/$cm^3$ or more.

(4) The neutron shielding material of (3), wherein the epoxy resin of the epoxy resin composition possesses an alicyclic skeleton.

(5) The neutron shielding material of (4), wherein the epoxy resin possessing an alicyclic skeleton is an epoxy resin obtained by epoxidation of a cyclic olefin.

(6) The neutron shielding material of (4), wherein the epoxy resin possessing an alicyclic skeleton is an epoxy resin obtained by hydrogenation of an aromatic epoxy resin.

(7) The neutron shielding material according to any of (2) to (6), wherein the curing agent of epoxy resin is an amine possessing alicyclic skeleton or an aliphatic amine (8) The neutron shielding material according to any of (1) to (7), wherein the neutron shielding material is produced by a molding method.

That is, the essential factor of the present invention is a neutron shielding material possessing an epoxy resin and an amine curing agent as essential components, wherein said epoxy resin is an epoxy resin possessing an alicyclic skeleton and an amine curing agent is an alicyclic diamine curing agent.

The resin composition referring to the present invention has excellent transparency and excellent neutron shielding ability based on high hydrogen atom number density.

DETAILED DESCRIPTION OF THE INVENTION

The present invention will be discussed below in more detail.

Starting Material: Epoxy Resin

The epoxy resin used in this invention is an epoxy resin possessing an alicyclic skeleton.

As the epoxy resin possessing an alicyclic skeleton, an epoxy resin selected from a group composed of an epoxy resin obtainable by epoxidation of a cyclic olefin and epoxy resin obtainable by hydrogenation of an aromatic epoxy resin is desirable.

The following are examples of an alicyclic epoxy resin obtained by epoxidation of a cyclic olefin:

3, 4-epoxycyclohexylmethyl-3',4'-epoxycyclohexanecarboxylate 1,2-epoxy-vinylcyclohexene, bis(3, 4-epoxycyclohexylmethyl) adipate, 1-epoxyethyl-3,4-epoxycyclohexane, limonenediepoxide, oligomer type alicyclic epoxy resin (product name of Daicel Chemical Industries Ltd.; Epolead GT300, Epolead GT400, EHPE-3150). Among these products, 3,4-epoxycyclohexylmethyl-3',4'-epoxycyclohexanecarboxylate is desirable, and by blending this alicyclic epoxy resin, the viscosity of the epoxy resin composition can be dropped, and, accordingly, efficiency of work can be improved.

The following are examples of an epoxy resin obtained by hydrogenation of an aromatic epoxy resin: bisphenol A epoxy resins, bisphenol F epoxy resins, 3,3',5,5'-tetramethyl-4,4'-bisphenol epoxy resins, biphenyl epoxy resins such as 4,4'-biphenol epoxy resins, phenol-novolac epoxy resins, cresol-novolac epoxy resins, bisphenol A novolac epoxy resins, naphthalenediol epoxy resins, tris-phenylolmethane epoxy resin, tetrakisphenylolethane epoxy resins or epoxy resins prepared by hydrogenation of aromatic ring of aromatic epoxy resin such as phenoldicyclopentadienenovolac epoxy resins. Among these compounds, bisphenol A epoxy resins, bisphenol F epoxy resins or epoxy resins prepared by hydrogenation of aromatic ring of biphenol epoxy resins are desirable because epoxy resins having a high hydrogenation ratio can be obtained by these compounds.

The hydrogenation ratio of hydrogenated epoxy resins obtained by hydrogenation of these aromatic epoxy resins is desirably from 90 to 100%, and more desirably from 95 to 100%. When the hydrogenation ratio is smaller than 90%, the resin absorbs short wavelength light and deterioration of the resin is caused by time elapse, and is not desirable. Said hydrogenation ratio can be measured by finding a change of absorbancy (wavelength: 275 nm) using an absortiometer.

With respect to the above-mentioned alicyclic epoxy resins, one kind can be used alone or used together with other kinds.

<Curing Agent>

As a curing agent which is used in the present invention, an amine possessing an alicyclic skeleton, specifically a compound represented by the following general formula (1) or an aliphatic amine can be desirably used.

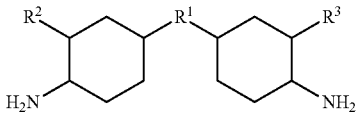

(1)

(in the formula, $R^1$ is one selected from the group consisting of a direct bond, methylene group, —$C(CH_3)_2$—, —O— or —$SO_2$—, $R^2$ and $R^3$ independently is hydrogen atom or alkyl group of carbon number 1-4)

$R^1$ is one selected from the group consisting of a direct bond, methylene group, —$C(CH_3)_2$—, —O— or —$SO_2$—, desirably is a methylene group or —$C(CH_3)_2$—. $R^2$ and $R^3$ independently is a hydrogen atom or an alkyl group of carbon number 1-4 and desirably is an alkyl group of carbon number 1-2.

An amine possessing an alicyclic skeleton to be used is not specifically restricted, however, for example, 1,2-diaminocyclohexane, 1,4-diaminocyclohexane, hydrogenated orthotoluenediamine, hydrogenated metatoluenediamine, hydrogenated metaxylilenediamine (1,3-BAC), isophoronediamine or isomer thereof, norbornanediamine, 3,3'-diethyl-4,4'-diaminodicyclohexyl-methane can be mentioned, and especially 3,3'-diethyl-4,4'-diaminodicyclohexyl-methane is desirable.

As an example of a compound represented by said general formula (1), concretely, 3,3'-dimethyl-4,4'-diaminodicyclohexylmethane, 3,3'-diethyl-4,4'-diaminodicyclohexylmethane, bis(4-amino-3-methyl-5-ethylcyclohexyl) methane, 3,3'-diethyl-4,4'-diaminodicyclohexylmethane or 4,4'-diamino-dicyclohexylmethane can be used, and especially 3,3'-dimethyl-4,4'-diaminodicyclohexylmethane is desirable.

As an example of an aliphatic amine, diethylenetriamine, triethylenetetramine, tetraethylenepentamine, hexamethylenediamine, metaxylilenediamine, trimethylhexamethylene diamine, 2-methylpenta-methylenediamine, diethylaminopropylamine, polyoxypropylene diamine, polyoxypropylenetriamine or N-aminoethylpiperazine or combination of these compounds can be used.

Further, a modified reactant of these polyamines with epoxy resin, a modified reactant of polyamines with a monoglycidil compound, a modified reactant of polyamines with epichlorohydrin, a modified reactant of polyamines with alkyleneoxide of carbon number 2-4, an amide oligomer obtained by chemical reaction of polyamines with a multifunctional compound possessing at least one acyl group or an amide oligomer obtained by chemical reaction of polyamines with a multifunctional compound possessing at least one acyl group and monovalent carboxylic acid and/or a derivative thereof can be used as a curing agent of epoxy resin. The above-mentioned amine possessing an alicyclic skeleton and an aliphatic amine can be used alone or can be used together.

In the present invention, blending an amount of a curing agent at an ordinary temperature curing epoxy resin can be properly selected according to the kind of curing agent. However, generally, the blending amount of the curing agent is 10-200 mass parts, desirably 20-100 mass parts to 100 mass parts of an epoxy resin.

<Other Additives>

The first essential point of the present invention is to reduce the energy which neutrons possess as generated by elastic collision of neutrons with hydrogen atoms, and as a result, to shield neutrons. That is, neutron causes nuclear reaction with specific nuclide and captured. As a neutron capturing agent, boron is well known.

In the present invention, a borate compound can be further added to the epoxy resin with which the above-mentioned curing agent is blended. Powder of borate compounds represented by $B_4C$, BN, $B_2O_3$ and $B(OH)_3$ can be added within the range so as not to spoil the effect of the present invention when necessary.

The shielding effect against γ-ray can be provided by adding boron glass (borosilicate glass) frit as one example of a powder of the borate compounds. Regarding the boron atom, although the presence of 14 kinds of isotopes of mass number from 6 to 21 is known, the stable isotopes are $^{10}B$ and $^{11}B$, and natural abundance of each is 18.8% and 80.2%. Neutron causes nuclear reaction with $^{10}B$ and captures neutron. For the practical use of the present invention, nature boron compound is desirable from an economical view point. Further, although there are various boron compounds such as oxide, sulfide, nitride or halide, boron glass (borosilicate glass) frit is desirable in the present invention. Boron glass (borosilicate glass) can be obtained by adding boric acid to glass, and the softening point and hardness of it are improved. Further, the term "frit" means a powder of glass.

The borosilicate glass frit to be used in the present invention is not restricted, and any kind of product available on the market can be used.

The particle size of the borosilicate glass frit to be used in the present invention is from 0.1 μm to 1000 μm, and desirably from 1 μm to 500 μm.

When the added amount of borosilicate glass frit is large, much the shielding effect will be improved. However, transmittance becomes bad. Therefore, it is necessary to determine the proper ratio for the addition of the borosilicate glass frit.

A desirable ratio for adding the borosilicate glass frit is from 0.1 to 13 wt %, and more desirably from 1 to 10 wt %.

Regarding the adding method of borosilicate glass frit, there is no restriction. However, a method which achieves a good dispersion state is desirable.

Further, Fe, Ni, Cu, W, Pb or high-density metal powder, such as an oxide of these metal elements, can be used as a γ-ray shielding agent within a range that does not spoil the effect of the present invention.

Other agents such as an antioxidant, a stabilizer, a reactive or nonreactive diluent, a plasticizer, a mold-releasing agent, a flame retardant, a pigment or a fluorescent substance can be added to the curable epoxy resin composition of the present invention within a range so as not to spoil the effect of the present invention when necessary. Further, for the purpose of improving the physical properties, such as thermal expansion coefficiency, hardness or thixotropy, fillers such as silica (fumed silica, colloidal silica or sediment silica) can be added. With respect to a glass, staple fiber glass, filament glass, woven glass fiber or non-woven fiber can be used and not limited by their form. With respect to the kind of glass, any kind of glass such as E glass, T glass, D glass or NE glass can be used.

Preparation Method of Molded Product

In the curing reaction of an epoxy resin composition, it is necessary to cure the product by controlling the generated reaction heat. In the present invention, in a case when a large amount of inorganic subject of high heat capacity is not added at all, it is indispensable to reliably control and remove heat generated by the curing reaction for the molding process. If heat of reaction cannot be controlled, molding strain will be caused. Accordingly, deterioration of a see-through feature originated from non-uniformity of the molded product will be caused. Further, in a case when a transparent organic shuttering is used, the shuttering itself is transformed and accordingly the molded product transforms too. Furthermore, bubbles, which become a cause of deterioration of neutron shielding ability, are contained in the molded product and cause serious defects for the shielding ability. Such a product cannot be used practically. Accordingly, in the present invention, the above-mentioned problems are solved by following the molding method. That is, for the molding process, the epoxy resin composition is previously defoamed, the mixture is divided and poured into a shuttering intermittently. Preventing rolling up of bubbles at the bottom of the gate of the shuttering, heat generated by curing is removed by outer cooling of the shuttering and performs the curing process under an ordinary temperature.

Mixing of starting materials: Components to be blended are weighted respectively and mixed. The mixer to be used for the mixing process is not specifically restricted. However, a mixer in which stirring and defoaming can be simultaneously carried out is desirable.

As the typical example, Chemical Mixer, a product of Aicohsha Co., Ltd. can be used.

Defoaming: The obtained mixture is defoamed using a specific defoamer. Since the required characteristics of the molded product of the present invention are neutron shielding ability and light transmissivity, establishment of a manufacturing technique which removes bubbles contained in the molded product as much as possible is indispensable. As a defoamer, Vacuum Deforming Apparatus of Otsuka Factory Co., Ltd. can be used. Defoaming time is decided considering the data of ascending temperature of the reacting heat of the mixture composed of a selected epoxy resin and a curing agent, and curing time.

Ordinary necessary defoaming time is 1 to 120 minutes and practically adjusted to 7-60 minutes.

Molding: Method for molding is not restricted, and a molding method characterizing to form a shuttering according to a necessary shape of the molded product and to pour the defoamed mixture to the shuttering can be used. After molding, the shuttering is placed under room temperature and the curing reaction progresses sufficiently. By measuring the temperature of the molded product, the end point of the curing can be detected.

Ordinary necessary curing time is 1 to 168 hours, and practically is 6 to 72 hours.

Estimation of a shielding material can be carried out as follows. Several pieces of a specimen of the same thickness are prepared and by piling up these specimens, the thickness of the shielding material can be adjusted.

Construction of measuring system. The neutron shielding ability can be measured as follows. Thickness of 1/10 value layer can be obtained from neutron shielding ratio calculated by dividing neutron incidence numbers to a shielding material with neutron transmission numbers through the shielding material.

As a neutron beam source, americium 241-Be, americium 241-Li or californium 252 are known, and it is desirable to sham energy spectral of a neutron to be shielded. Especially, regarding californium 252, since radiation dose isostere average energy is 2.40 MeV and energy spectral of neutron indicates Maxwell's distribution, can be used desirably.

For the measurement of neutron, a neutron survey meter on the market can be used.

EXAMPLES

The present invention will be illustrated more in detail by Examples. However, the invention is not intended to be restricted to the Examples.

Manufacturing Method of Molded Product

First Process 1.7 kg of hydrogenate (epoxy equivalent 200 g/eq, total chlorine amount 1400 ppm) obtained by polycondensation of epoxy resin (Product of Mitsubishi Chemical Corporation Product name: jER YX8000), 4,4'-isopropylidenediphenol with 1-chloro-2,3-epoxypropane, curing agent (Product of Mitsubishi Chemical Corporation Product name: jER cure 113), 4,4'-methylenebis(2-methylcyclohexane amine), 3,3'-dimethyl-4,4'-diamino dicyclohexylmethane and 0.8 kg of laromin C diamine (amine value: 98 mgKOH/g) are weighted and stirred for 20 minutes at ordinary temperature (23.7° C.) using a mixer. At the end of the stirring process, the temperature of the mixture is 27.3° C. This mixture is defoamed by a defoamer for 50 minutes. At the end of the defoaming process, the temperature of the mixture is 30.6° C. Specifications of a mixer and defoamer are mentioned below.

(1) Chemical Mixer

Maker: Aicohsha Co., Ltd.

Type: ACM-30LVT (special specification)

Specification: Originally three phase altering current, 200 volt is changed to single phase, 100 volt for the purpose to make fine adjustment of rotating number possible at low and middle rotating speed range.

Stirrer is biaxial (spiral hook type: SCS13 type)

With vacuum defoaming function at stirring process and with specific piping function.

(2) Defoaming Machine

Maker: Otsuka Factory Co., Ltd.

Type: Vacuum defoaming machine corresponding to pail can (with specific piping function.

Specification: 201 pail can corresponding type with a sensor (with chemical mixer connecting function)

Second Process

Shuttering for molding (200 mm×200 mm×20 mm) made of a transparent acrylic resin board (2 mm thickness) is prepared. The mixture obtained by the first process is slowly poured into the shuttering obliquely placed on a working table with a 15 degree angle along with side surface of the shuttering. Pouring is continued by changing the angle horizontally. The above-mentioned process is repeated 3 times and all of the mixture is poured into the shuttering. After the pouring process, temperature is measured 4 times at every 30 minutes and no abnormal phenomenon is detected. After the pouring process, the mixture is left for one week and the molded product specimen is obtained.

Measurement of Neutron Shielding Effect

The specimen is a transparent board of 200 mm×200 mm×20 mm. The dose rates of every thickness are measured by piling up the board and the neutron shielding ability is estimated. At a 1.2 m height position, the radiation source and the measuring apparatus are placed so that the distance between the radiation source and the measuring center of the measuring apparatus is 50.8 cm. In the case to set the specimen between and not to set the specimen measurement is repeated 10 times. Shielding ratio is calculated by averaging the values obtained by 10 measurements.

Radiation source is californium 252 (nominal value: 3.7 MBq) and Neutron Survey Meter TPS-451 of Aloka Co., Ltd. is used as a measuring apparatus.

Thickness of the specimen that indicates 90% shielding ratio is measured and obtained 12 cm thickness of the shielding board of 1/10 value layer of a neutron ray.

Measurement of Light Transmissivity

Spectrophotometer U-2010, which is the product of Hitachi High Tech Science Co., Ltd., is used and light transmissivity is measured based on JISK7361 (Plastic-Determination of the total luminous transmittance of the transparent materials).

Neutron shielding effect of the Example is shown in Table 1.

Comparative Example 1

1451 g of polycondensation product (epoxy equivalent 224 g/eq, total chlorine amount 47450 ppm) of epoxy resin (ST-3000 of Nippon Steel and Sumikin Chemical Co., Ltd.), 2,2'-bis(4-hydroxycyclohexylpropane) and 1-chrolo-2,3-epoxypropane, curing agent (HL-107 of Nippon Steel and Sumikin Chemical Co., Ltd.) and 581 g of denatured heterocyclic diamine are weighted, and molded product of 200 mm×200 mm×50 mm is obtained by the same process as used for the Example. Specimen of prescribed thickness is prepared by combining these molded products and provided to the measurement of shielding effect.

Neutron shielding effect of the Comparative Example 1 is shown in Table 2.

From the above-mentioned data, thickness of 1/10-value layer is 16 cm.

Measuring results of light transmissivity are summarized in Table 3.

Light transmissivity of the Comparative Example 1 is deteriorated from 500 nm (green color), and indicates 79.7% at 450 nm and 51.6% at 400 nm, that is, transmitted light is largely decreased at the blue-violet range and colored to a yellowish-brown color. On the contrary, in the Example, remarkable absorption cannot be observed by 450 nm, and at 450 nm indicates 84.9%, that is, high transmissivity is maintained. Coloring is not observed by naked eyes of the operator, that is, no colorless and transparent neutron shielding material is obtained.

Density and hydrogen atom number density are mentioned in Table 4. Regarding a conventional acrylic board, these values are mentioned for reference.

It is understood from Table 4 too that the Example shows a higher hydrogen atom number density and the neutron shielding effect is superior.

TABLE 1

| Thickness of material (cm) | Shielding ratio (%) |
|---|---|
| 0 | 0 |
| 2 | 32.3 |
| 4 | 56.4 |
| 6 | 70.9 |
| 8 | 80.7 |
| 10 | 86.1 |
| 12 | 90.4 |
| 14 | 92.9 |
| 16 | 95.1 |

TABLE 2

| Thickness of material (cm) | Shielding ratio (%) |
|---|---|
| 0 | 0 |
| 5 | 51.85 |
| 10 | 77.93 |
| 15 | 89.39 |
| 20 | 94.53 |
| 25 | 97.29 |
| 30 | 98.49 |
| 35 | 99.19 |
| 40 | 99.56 |

TABLE 3

| | Transmissivity (%) | |
|---|---|---|
| Wave length (nm) | Example | Comparative Example |
| 800 | 91.3 | 90.0 |
| 750 | 91.1 | 88.8 |
| 700 | 91.3 | 90.4 |
| 650 | 91.2 | 89.9 |
| 600 | 91.2 | 89.3 |
| 550 | 91.0 | 88.2 |
| 500 | 90.7 | 85.7 |
| 450 | 90.1 | 79.7 |
| 400 | 84.9 | 51.6 |
| 350 | 57.7 | 0.5 |
| 300 | 3.4 | 0.5 |
| 250 | 0.1 | 0.2 |

TABLE 4

| | Example | Comparative Example 1 | Reference Example (PMMA) $(C_5O_2H_8)n$ |
|---|---|---|---|
| Density ($g/cm^3$) | 1.06 | 1.13 | 1.18 |
| hydrogen atom number density ($atoms/cm^3$) × $10^{22}$ | 6.83 | 6.77 | 5.67 |

Comparative Example 2

Neutron shielding material is prepared by the same procedure as to Example 1 except it is maintained for 24 hours at 40° C. after the molding process. Transmissivities of the obtained shielding material are shown in Table 5.

Comparative Example 3

Neutron shielding material is prepared by the same procedure as to Example 1 except it is maintained for 24 hours at 60° C. after the molding process. Transmissivities of the obtained shielding material are shown in Table 5.

TABLE 5

| Wave length (nm) | Comparative Example 2 40° C. cured | Comparative Example 3 60° C. cured |
|---|---|---|
| 800 | 90.2 | 90.8 |
| 750 | 89.4 | 90.1 |
| 700 | 90.9 | 91.9 |
| 650 | 90.7 | 91.7 |
| 600 | 90.6 | 91.7 |
| 550 | 90.1 | 91.4 |
| 500 | 88.9 | 90.6 |
| 450 | 86.2 | 87.5 |
| 400 | 72.7 | 59.4 |
| 350 | 23.1 | 6.8 |
| 300 | 0.0 | 0.0 |
| 250 | 0.0 | 0.0 |

The neutron shielding agent of the present invention has transparency and has high neutron shielding ability, and therefore, is preferably used in various hot laboratories as an excellent neutron shielding material.

The invention claimed is:

1. A neutron shielding material whose light transmittance at a wavelength of from 400 nm to 700 nm is 80% or greater, and whose thickness of 1/10 value layer of neutron beam generated from Californium 252 is 14 cm or less.

2. The neutron shielding material of claim 1, wherein the neutron shielding material is a cured product of an epoxy resin composition.

3. The neutron shielding material of claim 2, wherein the number density of hydrogen atom of the epoxy resin composition is $6.78\times10^{22}$ $atoms/cm^3$ or more.

4. The neutral shielding material of claim 3, wherein the epoxy resin of the epoxy resin composition possesses an alicyclic skeleton.

5. The neutron shielding material of claim 4, wherein the epoxy resin possessing an alicyclic skeleton is an epoxy resin obtained by epoxidation of a cyclic olefin.

6. The neutron shielding material of claim 4, wherein the epoxy resin possessing an alicyclic skeleton is an epoxy resin obtained by hydrogenation of an aromatic epoxy resin.

7. The neutron shielding material according to claim 2, wherein the curing agent of epoxy resin is an amine possessing an alicyclic skeleton or an aliphatic amine.

8. The neutron shielding material according to claim 1, wherein the neutron shielding material is produced by a molding method.

* * * * *